United States Patent [19]

Borenstein et al.

[11] 3,936,916

[45] Feb. 10, 1976

[54] METHOD AND APPARATUS FOR THE PRODUCTION OF TEXTURED YARN

[75] Inventors: David E. Borenstein; Charles S. Hatcher, both of Greenville, S.C.

[73] Assignee: Phillips Petroleum Company, Bartlesville, Okla.

[22] Filed: May 9, 1974

[21] Appl. No.: 468,489

[52] U.S. Cl. ..... 28/1.6; 28/72.14

[51] Int. Cl.[2] ..... D02G 1/12

[58] Field of Search ..... 28/106, 107, 72.14

[56] References Cited

UNITED STATES PATENTS

| | | | |
|---|---|---|---|
| 2,949,659 | 8/1960 | Heijnis et al. | 28/1.6 |
| 3,153,271 | 10/1964 | Eshuis | 28/1.6 |
| 3,153,837 | 10/1964 | Schippers et al. | 28/1.7 |
| 3,440,699 | 4/1969 | Stanley | 28/1.6 |
| 3,650,001 | 3/1972 | Nikkel | 28/1.6 |
| 3,678,547 | 7/1972 | Newton | 28/1.6 |
| 3,693,222 | 9/1972 | Caffry | 28/1.6 |
| 3,707,745 | 1/1973 | Nikkel | 28/1.6 X |
| 3,778,872 | 12/1973 | Newton | 28/1.6 |

FOREIGN PATENTS OR APPLICATIONS

| | | | |
|---|---|---|---|
| 689,536 | 6/1964 | Canada | 28/1.6 |
| 883,119 | 11/1961 | United Kingdom | 28/72.14 |

*Primary Examiner*—Robert R. Mackey

[57] ABSTRACT

Yarn is passed to a texturing zone wherein a yarn wad is formed, and the yarn wad is then passed through a flexible sleeve in a restraining zone wherein the yarn wad is restrained by a plurality of individual stacked members. In addition an apparatus is provided useful in the method of the invention.

13 Claims, 3 Drawing Figures

METHOD AND APPARATUS FOR THE PRODUCTION OF TEXTURED YARN

BACKGROUND OF THE INVENTION

The invention relates to a method and apparatus for the production of yarn.

Synthetic fibers are commonly produced by extruding molten polymer through a spinneret. In order to produce yarns which have properties approximating those of wool or other natural materials, it is common practice to subject the extrudate from the spinneret to a texturing process. This can be accomplished by a variety of procedures known in the art, such as stuffer-box crimping, false twisting, and fluid jet texturing. One particularly effective procedure involves passing the yarn to be textured and a high velocity fluid to a first passage. Subsequently, the yarn and the fluid are passed to an enlarged passage and then to a zone where the yarn is restrained and cooled. In the restraining zone individual stacked members, such as balls are used to exert a force on the yarn to restrain the yarn, which is in the form of a yarn wad. The fluid escapes from the yarn through the voids between the stacked members and a textured yarn is removed from the restraining zone. Although this procedure produces a high quality textured yarn, a particularly troublesome problem involves loss of the stacked members from the restraining zone. Frequently, stacked members become entrained in the yarn wad and are carried away from the restraining zone. Also sudden disruptions in the texturing process cause the stacked members to be thrown from the restraining zone. In addition, operators occasionally knock stacked members from the restraining zone during string up and maintenance of the equipment. Further, recovering the stacked members from the floor and/or replacing them with new ones involves considerable expense, particularly where a number of such processing lines are used.

Although it would appear such a problem could be easily solved, this has not been the case. In order for the stacked members to function properly, they must be free to act upon the yarn wad, and in addition, the restraining zone containing the stacked members must be designed to allow the operator to easily string up and maintain the equipment. It has been very difficult to satisfy both of these conditions simultaneously. However, the present invention achieves such a result.

It is an object of the invention to restrain yarn.

Another object of the invention is to restrain and cool yarn textured using a fluid jet texturing process.

Another object of the invention is to eliminate the loss of stacked members from a restraining zone.

Still another object of the invention is to provide an apparatus useful for restraining yarn.

Yet another object of the invention is to provide an apparatus useful to cool and restrain yarn textured with a fluid jet wherein the apparatus contains individual stacked members which are not removed from the apparatus by the operation thereof.

Other aspects, objects, and advantages of the invention will be apparent to those skilled in the art upon studying the drawings, specification, and the appended claims.

SUMMARY OF THE INVENTION

In accordance with the invention, a textured yarn is passed to a restraining zone containing a flexible sleeve through which the yarn is passed and a plurality of individual stacked members, said flexible sleeve being positioned so as to prevent said stacked members from being removed from said restraining zone as the stacked members exert a force upon the flexible sleeve which in turn exerts a restraining force upon the yarn.

Further according to the invention, an apparatus for restraining yarn comprises a chamber having an inlet and an outlet and an inner and outer surface; a flexible sleeve having an inlet and an outlet through which the yarn is directed and an inner and an outer surface, the inlet of the flexible sleeve being attached to the inlet of the chamber and the sleeve being positioned in and extending through the chamber; and a plurality of individual stacked members positioned in the chamber between the inner surface thereof and the outer surface of the flexible sleeve.

DETAILED DESCRIPTION OF THE INVENTION

Figure 1:
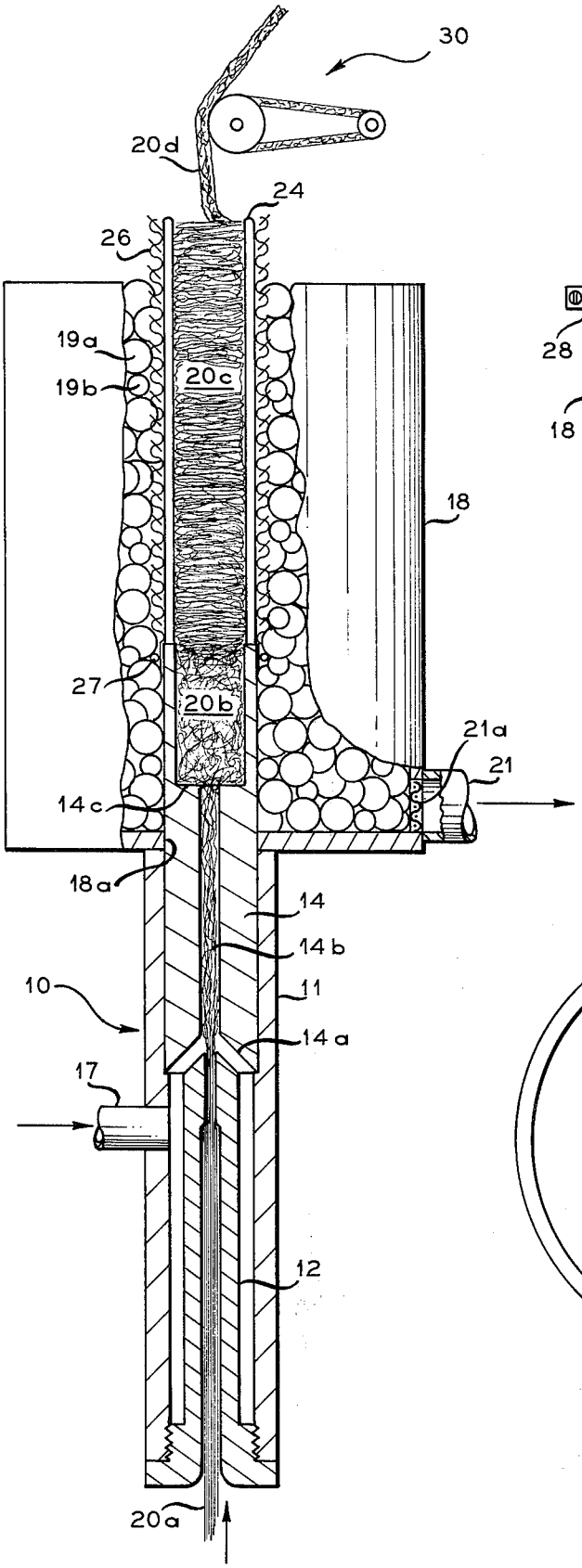
FIG. 1 illustrates an embodiment of the apparatus of this invention and a fluid jet which is employed to texture the yarn.

Referring now to the drawings and to FIG. 1 in particular, there is shown a crimping or texturing apparatus generally designated by reference numeral 10. This apparatus comprises an elongated sleeve 11 which has a hollow needle 12 positioned in the inlet section thereof. An elongated plug 14 is disposed in the outlet section of sleeve 11. Plug 14 has a central opening **14*b* therethrough. The inlet of opening 14*b* is tapered to provide a seal 14*a* adjacent the tip of the needle 12. The outlet of central opening 14*b* constitutes a section 14*c* of increased diameter. A conduit 17 communicates with sleeve 11 adjacent needle 12** to introduce a fluid, such as steam or air, at an elevated temperature. The above described apparatus is generally known as a fluid jet for texturing yarn.

Figure 3:
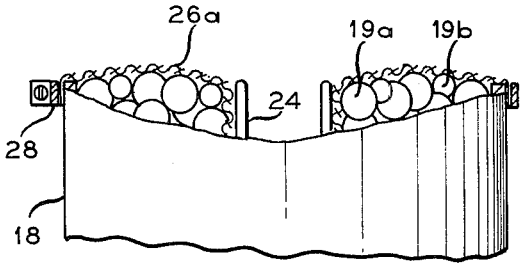
FIG. 3 illustrates another embodiment of the invention used with a fluid jet.

Further according to the invention, a hollow chamber 18 having an inlet **18*a* is mounted immediately above sleeve 11 to receive yarn which is crimped in the fluid jet. A large number of relatively small individual stacked members, such as balls, 19*a* and 19*b*, are disposed within chamber 18. Chamber 18 can be provided with an outlet conduit 21 which is connected to a drain or to a source of reduced pressure, not shown. A screen 21*a* is positioned across conduit 21 to retain balls 19*a* and 19*b* within chamber 18. A plurality of rigid members 24, generally defining a rigid cylindrical sleeve, are used to guide the yarn wad 20*c*. A flexible sleeve 26 is attached to the inlet 18*a* of chamber 18 using a clamp 27 and is positioned between the stacked members 19*a*, 19*b* and the yarn wad 20*c*. The upper end of sleeve 26 can be loose or, as shown in FIG. 3, the flexible sleeve 26 can be extended to enclose the stacked members 19*a*, 19*b* by clamping an extended portion of the flexible sleeve 26*a* to the hollow chamber 18 with clamp 28.**

In the operation of the apparatus of FIG. 1, one or more filaments **20*a* are inserted through needle 12 into the central passage of plug 14. These filaments can be delivered to the apparatus by any suitable feed means, not shown. In the normal start-up operation, the filaments are threaded completely through the apparatus. Fluid is introduced through conduit 17 and flows upwardly through plug 14 into chamber 18. In the present embodiment which employs a fluid jet to texture the yarn, chamber 18 functions both as a restraining zone and a cooling zone. The fluid so introduced surrounds needle 12 to elevate the temperature of the incoming filaments. The velocity of the introduced fluid is sufficiently high to produce a zone of substantial turbulence in the outlet region 14***c* of plug 14. The yarn 20*b* in the turbulent zone passes upwardly to form an elongated generally cylindrical wad 20*c* in the center of chamber 18 which is guided by a plurality of rigid members, such as rods 24. This wad 20*c* passes through the flexible sleeve 26 which is surrounded by a plurality of stacked members, such as balls 19*a* and 19*b*. The balls confine and restrain the yarn wad, but they are prevented from becoming entrained in the yarn wad by the flexible sleeve. The fluid passes through pores in the flexible sleeve and into the voids between the individual stacked members. The yarn is cooled in passing through chamber 18 so that permanent crimps are imparted. The resulting textured yarn 20*d* is removed through a take-up device 30 and passed to a storage zone, not shown.

The velocity and temperature of the fluid introduced through conduit 17 are such as to impart the desired degree of crimp in the yarn. If desired, an external heater can be employed to assist in elevating the temperature of the crimping apparatus 10. The texturing fluid passes upwardly through the central opening 14*b* of plug 14, into chamber 18, and out through flexible sleeve 26 and voids between the stacked members, such as balls 19*a*, and 19*b*.

The stacked members can be formed of metal, glass or any other material which is inert to the yarn at the temperatures encountered. Stacked members in the shape of spheroids or balls have produced good results; however, the invention is not limited to the use of balls as the stacked members, since other configurations of stacked members are also suitable, such as for example ellipsoids. As illustrated, stacked members 19*a* are larger than stacked members 19*b* to provide better packing; however, the stacked members can be all the same size. The height of the stacked members in chamber 18 should be sufficient to produce the desired degree of restraint.

It is important to point out that when the restraining zone of the present invention is in communication with a fluid jet texturing zone, and thus is used therewith, the restraining zone also functions as a cooling zone, particularly where the flexible sleeve contains pores through which the fluid can pass. However, it is equally important to point out that although the present invention finds particular applicability when used in conjunction with a fluid jet texturing zone, that the invention should not be limited thereby in its broadest aspect. In general, the present invention can be used with most any process or apparatus in which it is desirable to use a container of stacked members through which a product passes and in which it is desirable to prevent the stacked members from being removed from the container.

Figure 2:
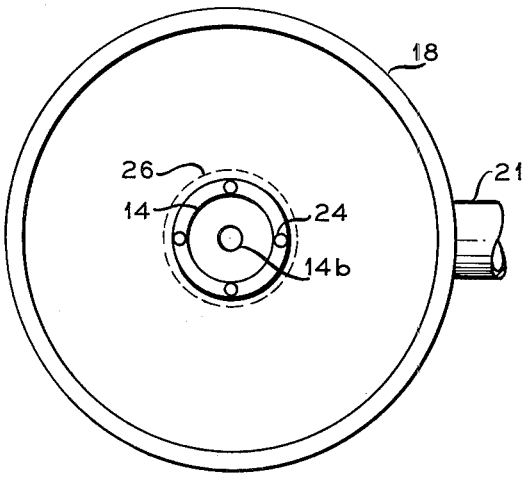
FIG. 2 is a plan view of the embodiment of FIG. 1.

As for the construction of flexible sleeve 26, a variety of materials are suitable. For example, flexible materials such as nylon, polyester, polyolefins, glass, metal wire and polytetrafluoroethylene can be used to advantage. Suitable materials are usually woven or formed into the flexible sleeve. Generally, flexible sleeve 26 is constructed with a cross-sectional area larger than that of section 14*c;* however, the cross-sectional area of the flexible sleeve can be smaller than that of section 14*c* if the flexible sleeve is capable of expanding sufficiently to permit the stacked members to exert the primary restraining force on the yarn wad rather than the flexible sleeve. It is emphasized that the purpose of the flexible sleeve is to isolate the stacked members from the yarn, that is, to prevent the stacked members from becoming entrained in the yarn; but at the same time the flexible sleeve permits the stacked members to restrain the yarn. When used with a fluid jet, the flexible sleeve 26 should contain pores which are of sufficient size to permit passage of the fluid but not the stacked members or balls 19*a*, 19*b* as shown in FIG. 1. In FIG. 2, the rigid sleeve as indicated by rods 24, is positioned on the yarn side of the flexible sleeve 26; however, the flexible sleeve can be positioned on the yarn side of the rigid sleeve if desired.

In one specific example of this invention utilized in conjunction with a fluid jet as illustrated in FIG. 1, balls 19*a* had a diameter of about one-fourth inch; and balls 19*b* had a diameter of about one-eighth inch. Approximately 70 percent of the total number of balls in chamber 18 were balls of ¼-inch diameter. Chamber 18 had an internal diameter of about 3 inches, with the depth of balls being about 4 inches. The diameter of the yarn wad produced in the fluid jet was approximately three-fourth inch. The flexible sleeve was constructed from nylon 6, 6 double knit, which had 44 courses per inch and 32 wales per inch. The nylon double knit was made from 100 denier, 34 filament yarn. The flexible sleeve was 1¾ inches inside diameter and 5¾ inches long.

In one specific mode of operation, a bundle of 126 polypropylene filaments having a denier of about 1800–2000 was introduced into the above described fluid jet at a velocity of about 1000–1100 meters per minute. Superheated steam at 90 psig and 365°F was introduced at a rate of about 20 pounds per hour. The textured yarn was removed at a velocity of about 800 meters per minute.

Approximately 30 pounds of textured yarn were produced employing the above apparatus. No balls were carried away from the hollow chamber of entrainment in the yarn wad or thrown from the hollow chamber due to disruptions in the texturing process. Also string up by the operator was readily accomplished.

While this invention has been described in conjunction with presently preferred embodiments, it obviously is not limited thereto.

What is claimed is:

1. A method comprising:

passing a yarn to be textured to a yarn texturing zone; and passing the yarn directly to a restraining zone in which a yarn wad forms, said restraining zone containing a rigid sleeve, a plurality of individual stacked members and a flexible sleeve through which the yarn wad passes, said rigid sleeve being positioned intermediate the yarn wad and the stacked members to assist in guiding the yarn wad through the restraining zone, said flexible sleeve being of substantially uniform diameter and being positioned intermediate the yarn wad and the stacked members so as to prevent said stacked members from being removed from said restraining zone by becoming entrained in the yarn wad as the stacked members confine and restrain the yarn wad.

2. The method of claim 1 wherein said texturing zone is a fluid jet texturing zone, said flexible sleeve has porous walls wherein the pores are of sufficient size to allow passage of a fluid used in the fluid jet texturing zone but to prevent passage of said stacked members, and said restraining zone also functions as a cooling zone.

3. The method of claim 1 wherein the stacked members comprise balls and the rigid sleeve comprises a plurality of rods.

4. The method of claim 3 wherein the balls include balls of different sizes.

5. The method of claim 1 wherein said flexible sleeve is constructed from a material selected from the group consisting of nylon, polyester, polyolefin and polytetrafluoroethylene.

6. Apparatus for restraining a yarn wad comprising:

a yarn texturing means having an inlet and an outlet;

a chamber having an inlet and an outlet and an inner and outer surface, said inlet attached to the outlet of the texturing means;

a flexible sleeve having a substantially uniform diameter and having an inlet and an outlet and an inner and an outer surface, said inlet of said sleeve being attached to the outlet of said texturing means and said sleeve being positioned in and extending through said chamber;

a plurality of individual stacked members positioned in said chamber between the inner surface thereof and the outer surface of said flexible sleeve; and a rigid sleeve disposed in said chamber adjacent the inlet thereof and extending therethrough to form an extension of said inlet, said rigid sleeve constructed so as to permit the stacked members to pass therethrough.

7. The apparatus of claim 6 wherein said yarn texturing means is a fluid jet and said flexible sleeve has a cross-sectional area larger than the outlet of the yarn texturing means.

8. The apparatus of claim 6 wherein said stacked members comprise balls.

9. The apparatus of claim 8 wherein said balls include balls of different sizes.

10. The apparatus of claim 6 wherein said rigid sleeve comprises a plurality of rigid members spaced from one another and generally defining a rigid cylindrical sleeve.

11. The apparatus of claim 10 wherein said rigid members are rods positioned inside said flexible sleeve.

12. The apparatus of claim 6 wherein the flexible sleeve is constructed from a material selected from the group consisting of nylon, polyester, polyolefin and polytetrafluoroethylene.

13. The apparatus of claim 6 wherein said stacked members are completely enclosed by said chamber and said flexible sleeve.

* * * * *